United States Patent [19]

Kamp

[11] 4,066,218

[45] Jan. 3, 1978

[54] METHOD AND DEVICE FOR SUPPLYING EMPTY CONICAL COIL CORES TO THE INDIVIDUAL WINDING STATIONS OF A TEXTILE MACHINE

[75] Inventor: Heinz Kamp, Rickelrath, Germany

[73] Assignee: W. Schlafhorst & Co., Monchen-Gladbach, Germany

[21] Appl. No.: 617,436

[22] Filed: Sept. 29, 1975

[30] Foreign Application Priority Data

Sept. 27, 1974 Germany ..... 2446162

[51] Int. Cl.[2] ..... B65H 54/02

[52] U.S. Cl. ..... 242/35.5 A

[58] Field of Search ..... 242/35.5 A

[56] References Cited

U.S. PATENT DOCUMENTS

| | | | |
|---|---|---|---|
| 2,394,262 | 2/1946 | Reifsnyder | 221/11 |
| 3,184,174 | 5/1965 | Furst | 242/35.5 R |
| 3,811,631 | 5/1974 | Mayer | 242/18 A |
| 3,940,077 | 2/1976 | Ohashi | 242/18 A |

FOREIGN PATENT DOCUMENTS

| | | | |
|---|---|---|---|
| 2,131,957 | 2/1973 | Germany | 242/35.5 A |

*Primary Examiner*—Harry N. Haroian

*Attorney, Agent, or Firm*—Herbert L. Lerner

[57] ABSTRACT

Method of feeding unwound conical coil cores to individual winding stations of a textile machine having a coil-exchanging device servicing a plurality of the winding stations for replacing fully wound coils with unwound conical coil cores, which comprises initially telescoping unwound coil cores into sticks of cores, supplying the sticks of cores to a core magazine wherefrom the coil exchanging device successively replenishes its own supply of cores, and separating a respective individual unwound conical coil core from the supply of cores of the coil exchanging device and exchanging it for a fully wound coil at a respective winding station; and device for carrying out the foregoing method.

9 Claims, 14 Drawing Figures

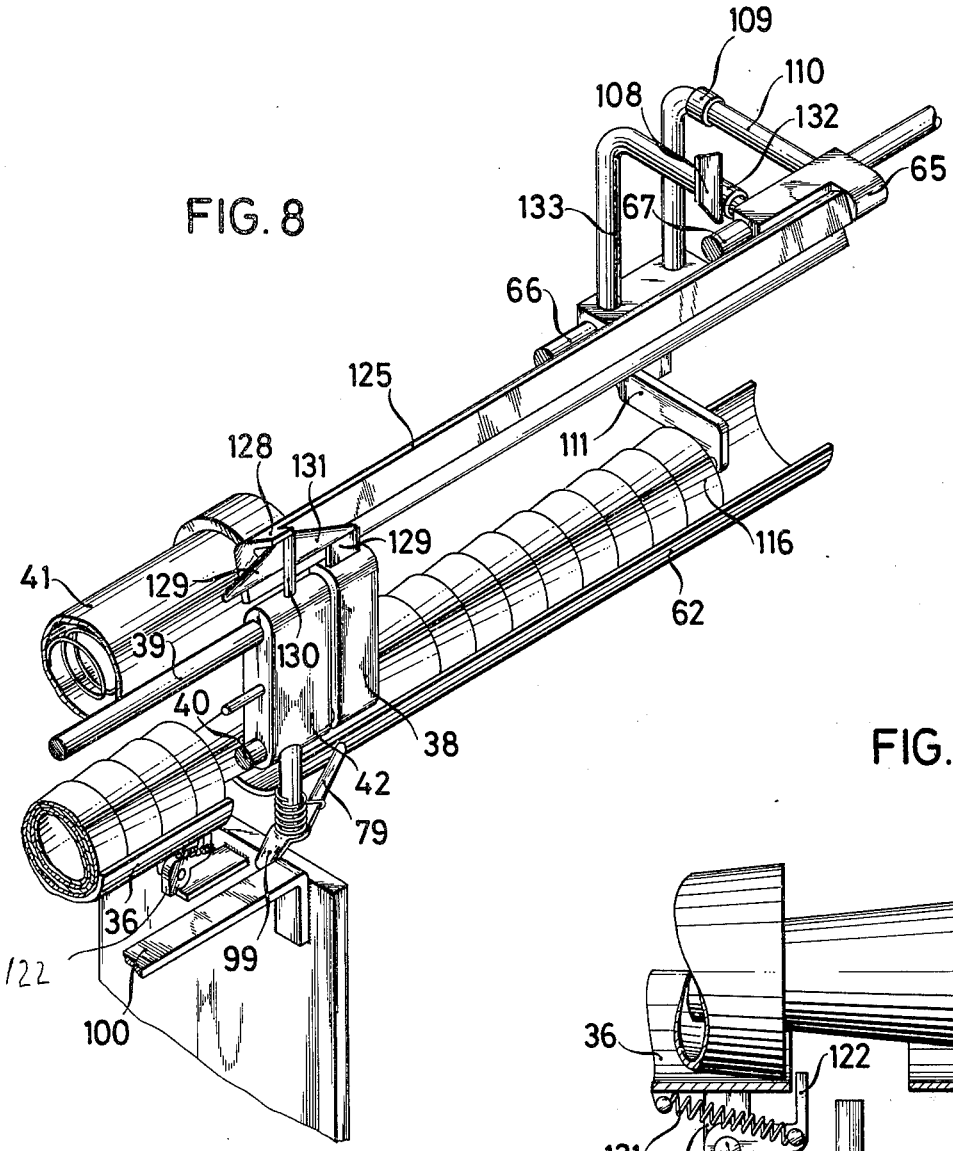
FIG. 8
FIG. 9
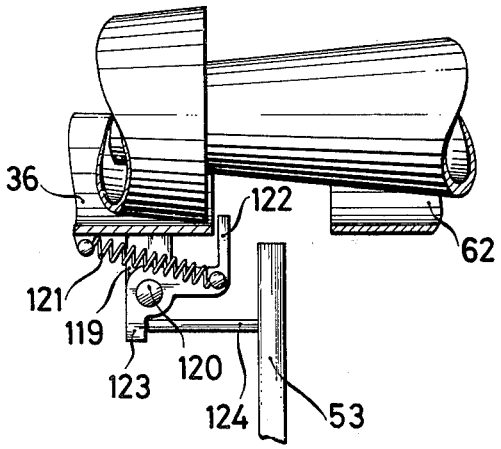
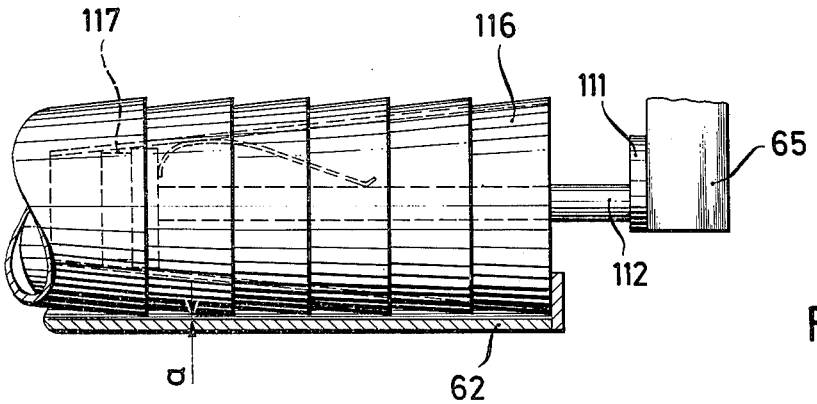
FIG. 10

METHOD AND DEVICE FOR SUPPLYING EMPTY CONICAL COIL CORES TO THE INDIVIDUAL WINDING STATIONS OF A TEXTILE MACHINE

The invention relates to a method of supplying empty or unwound conical coil cores to the individual winding stations of a textile machine, such as a winding or spinning machine, for example, with a coil exchanging device servicing a plurality of winding stations for replacing fully wound coils with empty or unwound conical coil cores; and a device for carrying out the foregoing method.

It has been known heretofore to provide the winding stations with a supply of individual empty or unwound coil cores and to replenish this supply periodically. The disadvantage of this heretofore known method is that the supply must be manually replenished, which is accordingly costly.

It has also been known heretofore to feed the empty or unwound coil cores to the individual winding stations by means of a conveyor belt. Such devices are also very expensive, require considerable space and limit the possibility of further constructively developing a winding or spinning machine.

It is accordingly an object of the invention to provide a method and device of the foregoing type which remedies the heretofore known situation and which, at relatively low cost, minimal space requirement and without greatly hindering the development possibilities for the construction of a winding or spinning machine, sweepingly automatizes the ready-holding of empty or unwound coil cores.

Starting from the possibility that conical coil cores permit themselves to be telescoped by being inserted one within the other, a fact that had heretofore been considered to be disadvantageous because of the consequent adhesive friction, there is provided in accordance with the invention and with the foregoing and other objects of the invention in view, a method of feeding unwound conical coil cores to individual winding stations of a textile machine having a coil-exchanging device servicing a plurality of the winding stations for replacing fully wound coils with wound conical coil cores, which comprises initially telescoping unwound coil cores into sticks of cores, supplying the sticks of cores to a core magazine wherefrom the coil exchanging device successfully replenishes its own supply of cores, and separating a respective indivicual unwound conical coil core from the supply of cores of the coil exchanging device and exchanging it for a fully wound coil at a respective winding station.

In accordance with another mode of the method of the invention, relative movement between the winding stations and the core magazine, on the one hand, and the operationally ready coil exchanging device, on the other hand, is maintained at all times other than the times of coil exchange and take-up of the telescoped unwound coil cores.

In accordance with a further mode of the method of the invention, the coil exchanging device is driven back and forth to the winding stations and the core magazine in operationally ready condition at times other than when a coil exchange and a take-up of unwound coil cores are occurring. This has the advantage that the coil exchanging device upon demand can be arrested and made operational again through relatively simple mechanical engagement at a winding station or at the core magazine.

In accordance with an additional mode of the method of the invention, the coil exchanging device is arrested at the core magazine whenever it travels past or arrives thereat, and the coil exchanging device is loaded with a full stick of cores or at least a major part of a stick of cores from the core magazine so that the supply of the coil exchanging device contains the greatest possible number of conical coil cores.

In accordance with yet another mode, the method of the invention comprises repeating the successive feeding of the sticks of cores at each transfer operation so often until the coil exchanging device has taken up the greatest possible supply thereof.

In accordance with the device for carrying out the method of the invention, there are provided a core magazine at the textile machine having means for receiving therein sticks of telescoped coil cores, transfer means for transferring individual sticks of cores and/or parts thereof to the coil exchanging device from the core magazine, and a take-up and storage device for sticks of coils and a delivery device for delivering individual coil cores, both located on the coil exchanging device.

In accordance with another feature of the device of the invention, the core magazine is constructed as an elevator and comprises at least ten troughs for receiving respective sticks of cores therein continuously maintained in substantially horizontal position. In this case, at least four troughs are always located on the take-up side. They can be conveniently reached for manual charging. Charging of the cores into the troughs advantageously accurs on the downward-running side of the elevator because the elevator can then stock up the largest possible number of core sticks. The transfer location for the sticks from the core magazine to the coil exchanging device is advantageously located at the apex of the elevator. Assurance is thereby provided that as many troughs as possible are filled or occupied and, therefore, the elevator is not unnecessarily large and costly.

In order to ensure that the coil exchanging device will always take up the necessary quantity of empty or unwound coil cores for replenishing the supply, there is provided in accordance with an added feature of the invention, a device of the foregoing type wherein the take-up and storage device of the coil exchanging device has means for selectively taking up individual coil cores, a plurality of telescoped coil cores, a full stick of coil cores or a plurality of sticks of coil cores.

Supplying of the textile machine with empty or unwound conical coil cores could be disrupted if only a few cores were missing in the supply of the coil exchanging device and therefore, no full core sticks can be taken up, or if no full core sticks but rather only parts or a core stick or individual cores are disposed in the troughs of the core magazine, yet the demand is greater, however. In order to prevent such disruptions, there is provided, in accordance with an additional feature of the invention, the foregoing device wherein the delivery device thereof comprises means responsive to the supply of unwound coil core present in the coil exchanging device for repeating the delivery operation and for dividing a stick of coil cores.

In accordance with a concomitant feature of the invention, the device of the foregoing type includes core hold-back means for preventing the coil cores from being forced back to the core magazine from the take-up and storage device of the coil exchanging device.

The advantages of the invention of the instant application especially include that a coil exchanging device servicing a plurality of winding stations is provided with a supply of empty or unwound coil cores and thereby has a further function to fulfil. This limited supply of the coil exchanging device is advantageously replenished successively from a large supply mounted adjacent the textile machine proper. For this purpose, advantageously, there is no requirement for conveyor devices, such as conveyor belts or the like for example, extending over the entire length of the textile machine. Other features which are considered as characteristic for the invention are set forth in the appended claims.

Although the invention is illustrated and described herein as embodied in a method and device for supplying empty conical coil cores to the individual winding stations of a textile machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 8 is another view similar to those of FIGS. 4 to 6 of the transfer device in another phase of the transfer operation;

FIG. 9 is an enlarged fragmentary front elevational view of the hold-back device of FIGS. 5 and 6 in a different phase of the transfer operation;

FIG. 10 is an enlarged fragmentary front elevational view of FIG. 4 showing further details of the transfer device;

Figure 1:
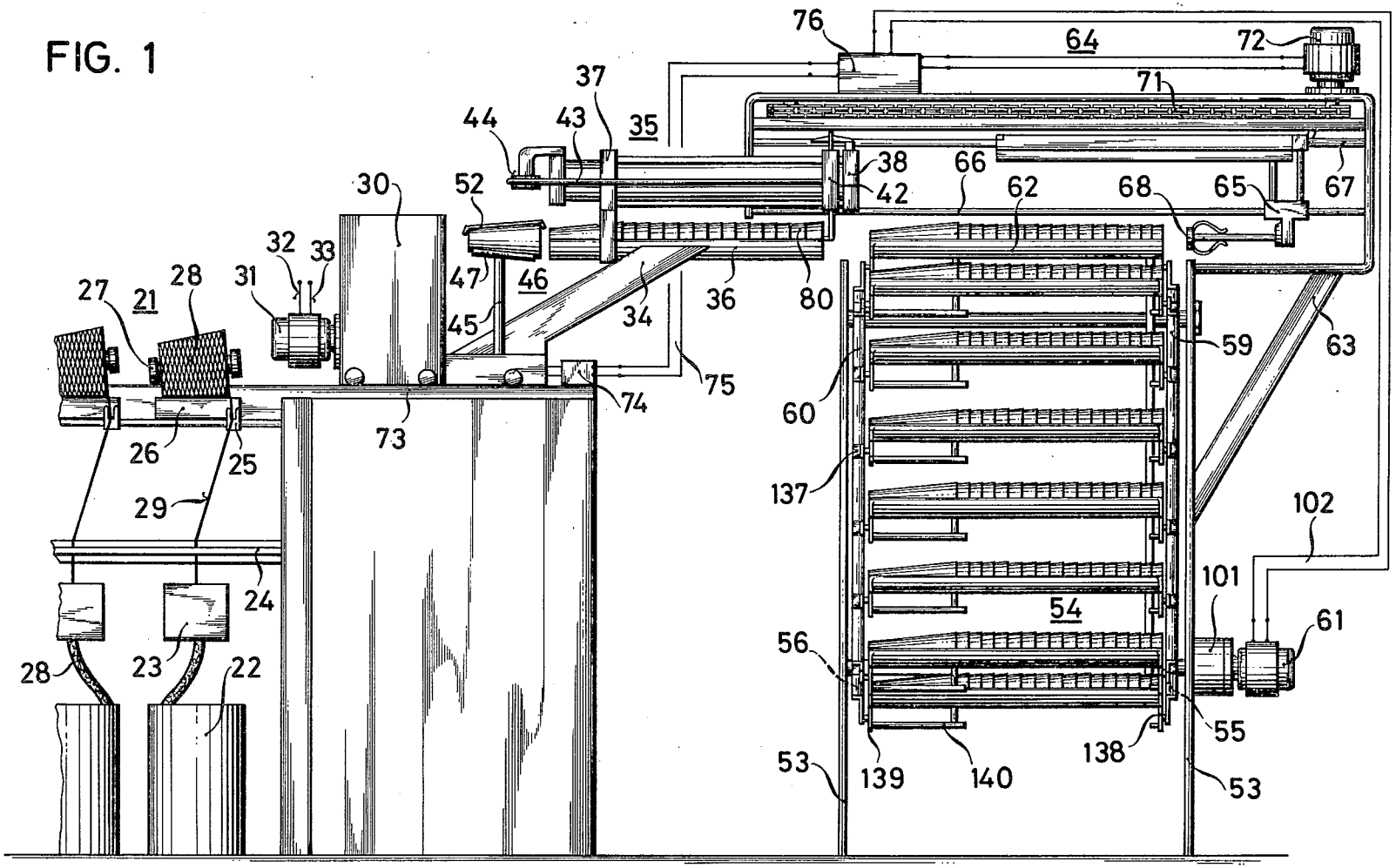
FIG. 1 is a diagrammatic front elevational view of a textile machine, constructed in accordance with the invention, having a coil exchanging device associated therewith and provided with a take-up and storage device for telescoped unwound coil cores, and a core magazine with a transfer device.
Figure 3:
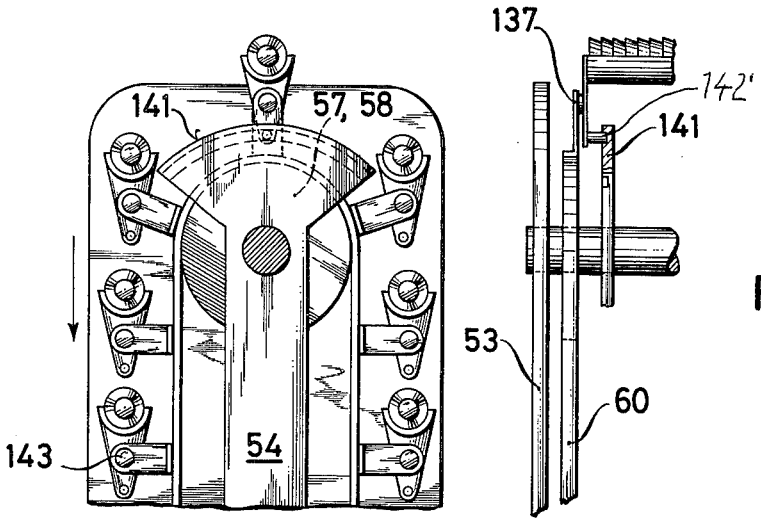
FIG. 3 is a fragmentary front elevational view of FIG. 2 showing several details of the core magazine of FIG. 2.

Referring now to the drawing and first, particularly, to FIG. 1 thereof, there is shown a textile machine 21 having a multiplicity of joined-together spinning and winding units, only two of which are shown in the figure.

The main parts of each winding station are formed of a can 22, a spinning device 23 and a thread-withdrawing device 24. Moreover, included at each winding station are a thread guide 25, a winding drive roller 26 and a cross-wound coil or cheese 28 retained by a winding frame 27. All of the foregoing parts are generally of conventional construction.

A sliver 28 of fibers is fed from the can 22 to the spinning device 23. The spun yarn or thread 29 is withdrawn by the threadwithdrawing device 24 from the spinning device 23 and is wound by means of the thread guide 25 and the winding drive roller 26 as a cross winding on the cross-wound coil or cheese 28'.

A traveling coil exchanging device 30 of conventional construction such as are known in principle from U.S. Pat. Nos. 3,184,174 and 3,092,340, for example is driven along and past the winding units by means of an electric motor 31, which is supplied with electrical energy through electric supply leads 32 and 33.

A take-up and storage device 35 for rods or sticks 80 of telescoped conical cores is secured to a traverse 34 of the coil exchanging device 30. As shown in FIGS. 5, 6 and 8 through 14, the take-up and storage device 35 is formed mainly of a supply trough 36, two carriers 37 and 38 secured to the supply trough 36, two guide rods 39 and 40 disposed between the carriers 37 and 38, a springforce storage device 41, a core counterrecoil mechanism 42 and a drive mechanism for the latter formed of a cable 43 and a cable reel 44.

Figure 11:
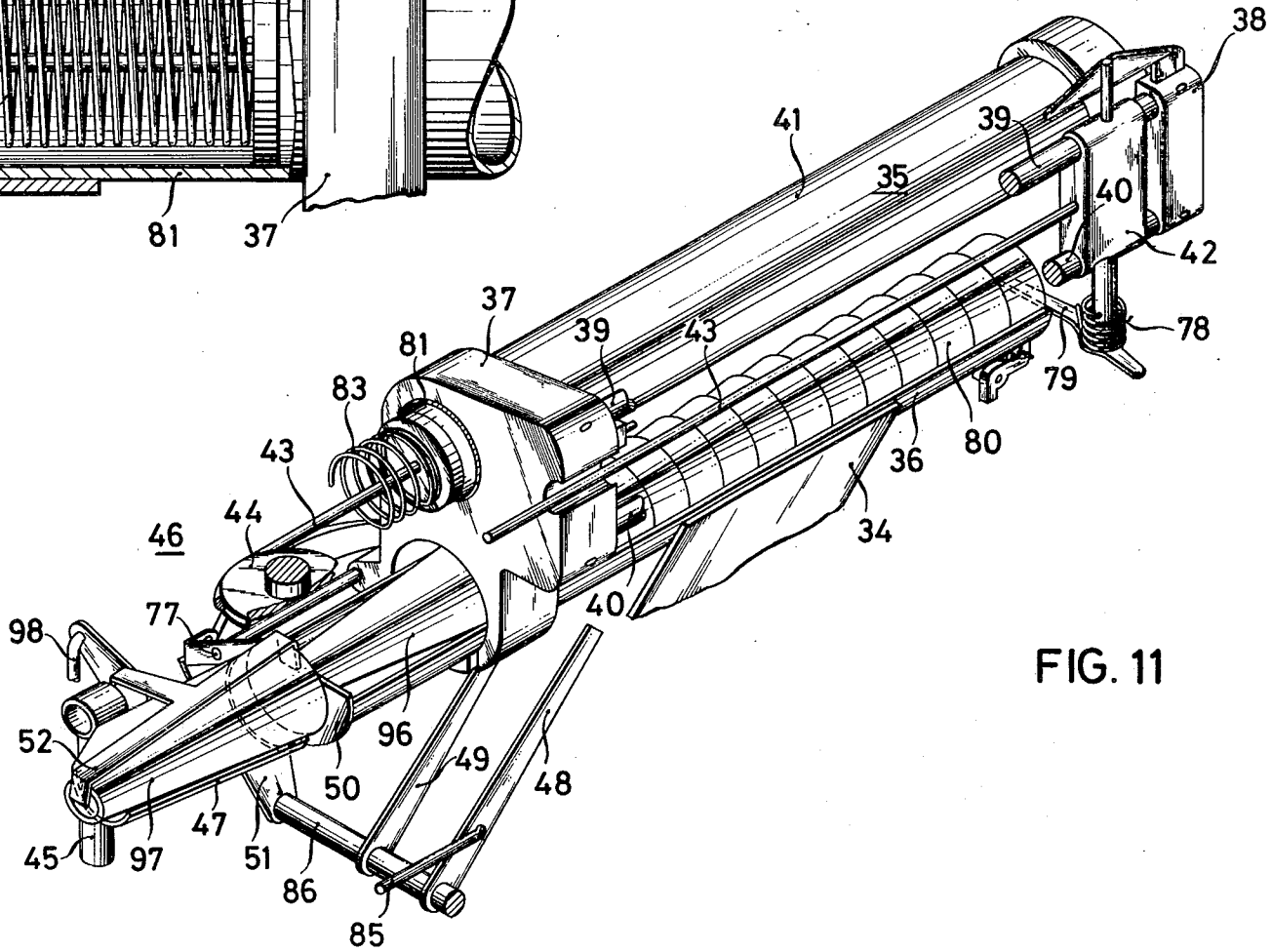
FIG. 11 is a perspective view similar to that of FIGS. 4, 5, 6 and 8 showing the transfer device and the core exchanging device for separating a single coil core from the supply thereof.
Figure 14:
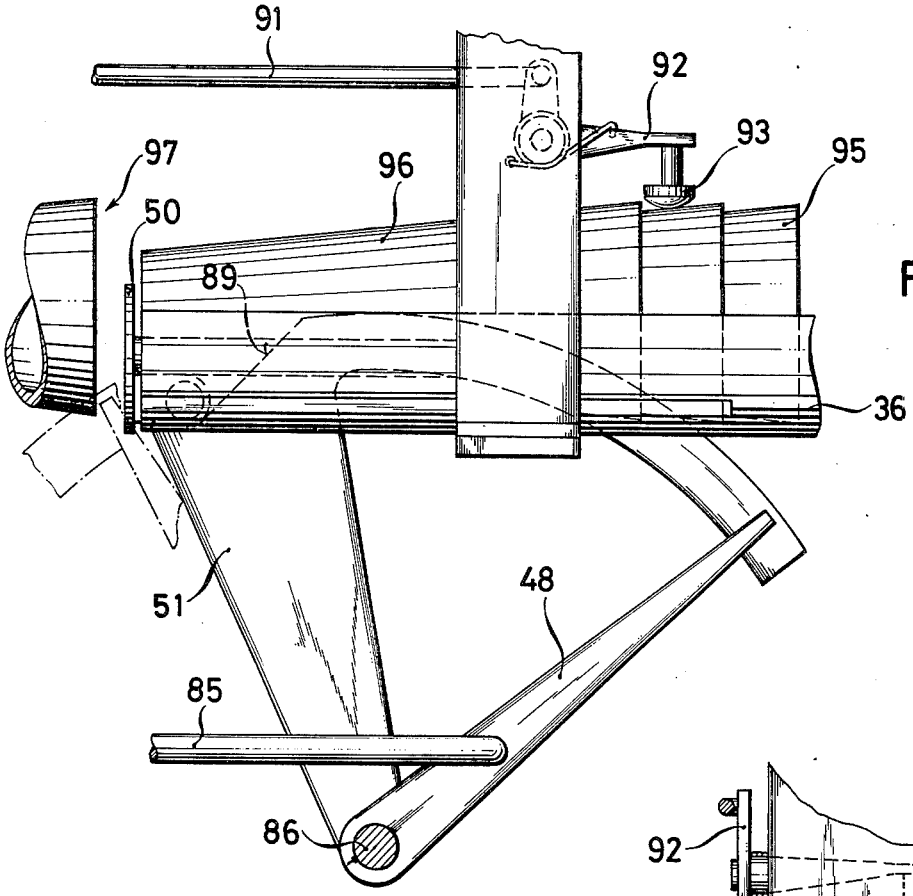
FIGS. 13 and 14 are fragmentary enlarged front and side elevational views of other details of the core exchanging device of FIG. 11.
Figure 13:
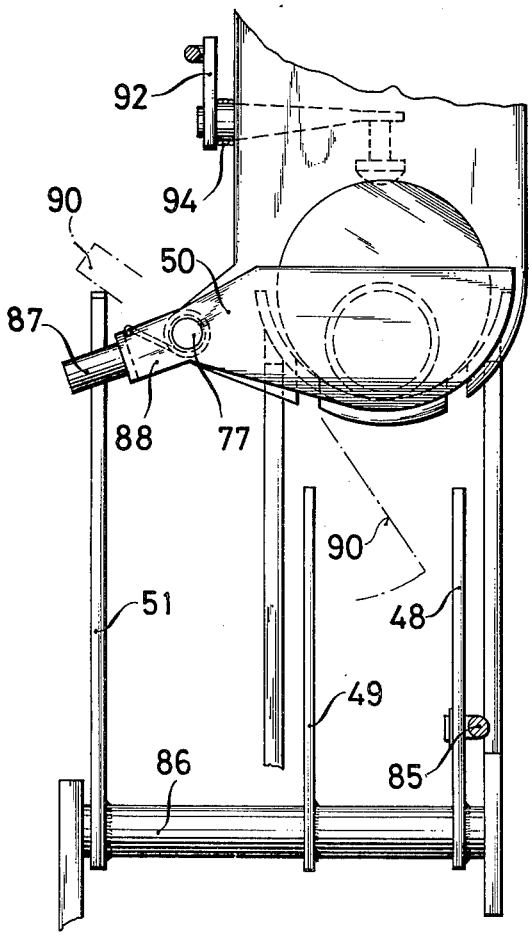

On a special supporting structure 45 of the coil exchanging device 30, a delivery device 46 for delivering individual unwound or empty conical coil cores is disposed, the details of which are particularly evident from FIGS. 11, 13 and 14.

The delivery device 46 is formed essentially of a core take-up trough 47, two wiping or stripping levers 48 and 49, a core stop or blocking member 50, a stop-opening segment 51 and a core gripper 52.

Figure 2:
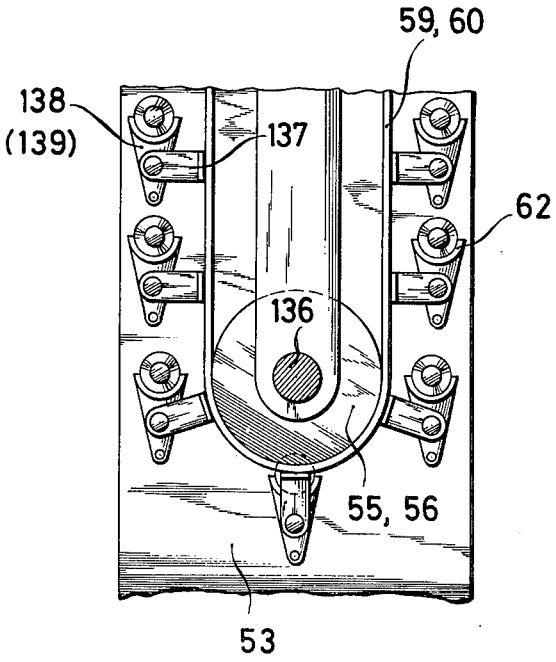
FIG. 2 is an enlarged side elevational view of the core magazine of FIG. 1.

A machine frame 53 installed at an end of the textile machine 21, as is especially apparent from FIGS. 1 and 2, carries a core magazine 54 constructed as an elevator. The main parts of the core magazine 54 are drive rollers 55 and 56, and reversing rollers 57 and 58, conveyor belts 59 and 60, respectively connected between the rollers 55 and 57, on the one hand, and the rollers 56 and 58, on the other hand, a drive motor 61 for the drive rollers 55 and 56 and, in the illustrated embodiment, fourteen uniformly dimensioned troughs 62 for receiving therein sticks or rods of cores 80.

A transfer device 64 is supported by a traverse 63 on the same machine frame 53 above the core magazine 54, details of contruction of the transfer device 64 being especially apparent from FIGS. 1, 4 to 8 and 10.

The transfer device 64 is primarily formed of a carriage 65 slidingly movable on guide rods 66 and 67, a plunger or ram 68 located on the carriage 65 and a chain drive for moving the carriage 65 and formed of spaced chain or sprocket wheels 69 and 70, an endless chain extending around the sprocket wheels 69 and 70, and drive motor 72 for driving the sprocket 69.

During the operation of the spinning machine 21 the coil exchanging device 30 travels in shuttling motion past the individual winding stations. It entrains or guides therewith in the supply trough 36 a supply of telescoped unwound or empty conical coil cores. The coil cores are advantageously telescoped with slight frictional adhesion or also virtually without any frictional adhesion.

As is readily apparent from FIGS. 11 and 13, the front of the stick of cores 80 abuts the core stop 50, which has the shape of a segment pivotable about the shaft 77. At the rear of the stick of cores 80, a lever 79 of the core counterrecoil device 42 presses against the end of the stick of cores 80, the lever 79 being loaded by a wound torsion spring 78.

The core counterrecoil mechanism 42 movably mounted on the guide rods 39 and 40 is continuously loaded or stressed in feed direction of the cores through the spring force storage device 41 by means of the cable 43 extending around the cable reel 44.

Figure 12:
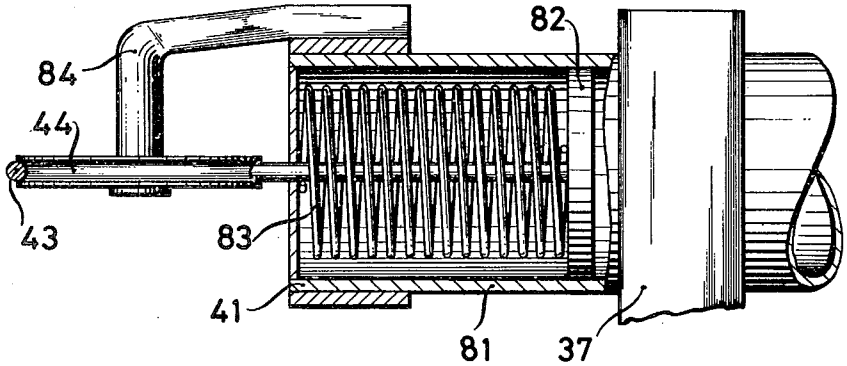
FIG. 12 is an enlarged elevational view, partly in section, of several details of the core exchanging device of FIG. 11.

The spring-force storage device 41 is formed of a cylinder 81, a piston 82 and a soft compression spring 83 with very many windings. A support arm 84 for the cable reel 44 is secured to the cylinder 81, as shown in FIG. 12. In this manner, the core counterrecoil mechanism 42 ensures that the stick of cores 80 is slidingly fed in transfer direction during delivery of the coil cores.

Whenever the coil exchanging device 30 has doffed or removed a completely wound cross-wound or cheese and requires a new unwound or empty conical coil core suitable for producing the next cross-wound coil for insertion into the coil frame 27, a non-illustrated control mechanism is tripped or actuated which controls the subsequent courses of movement.

As is seen especially in FIGS. 13 and 14, the wiper or stripping levers 48 and 49, which are firmly connected to a shaft 86, and the stop-opening or releasing segment 51 are turned by means of a pull rod 85 in counterclockwise direction, as viewed in FIG. 14. Thereby, as shown in FIG. 13, a guide roller 87 located on a lever arm 88 extending from the core stop member 50 rolls on a run-up surface 89 of the stop-opening or releasing segment 51. The core stop member 50 is thereby swung into the position 90 thereof shown by the dot-dash lines.

A pull rod 91 (FIG. 14) is simultaneously relieved of its load or stress so that a core down-holding member 93 secured to a bellcrank 92 and biased by a wound torsion spring 94 firmly holds down the next-to-last coil core 95 of the stick of cores 80. Although the core stop member 50 is then ineffective, the core counterrecoil mechanism 42 can no longer slide the stick of cores 80 because the frictional adhesion between the coil core 95 and the feed trough 36, which has been increased by the core down-holding member 93 is too great.

The wiper or stripping levers 48 and 49, as they swing farther, seize the edge of the coil core 96 and slide the core 96 into the position 97. The coil core accordingly slides onto the core takeup trough 47. Then, the shaft 86 swings back to the starting position thereof whereby the core stop member 50 is again actuated and the core counterrecoil device 42 again slidingly advances the stick of cores 80 in transfer or transport direction, when the core down-holder 93 is drawn back with the aid of the push rod 91.

The unwound or empty conical coil core then lying individually on the core take-up trough is seized by the core gripper 52 which is actuable by means of a pull rod 98 and, in a non-illustrated conventional manner, is inserted into the coil frame 27 of the respective winding station of the textile machine 21.

After a coil exchanging operation has been completed in the aforedescribed manner, the coil exchanging device 30 starts on its way. At the end of the travel path 73 thereof, it actuates a terminal switch 74 which is connected to a conventional switchgear installation 76 by an electrically conductive line 75.

Beforehand, a lever arm 99 of the core counterrecoil mechanism 42 has been turned outwardly by a stop rail 100 secured to the machine frame 53 of the core magazine 54 so that the lever 79 is swung to the side and thereby frees the path for subsequent sliding of further coil cores out of the core magazine 54. At that, a non-illustrated brake in the interior of the core counterrecoil mechanism 42 starts to function and so heavily brakes the core counterrecoil mechanism 42 on the guide rod 40 that it can no longer be pulled to the lefthand side, as viewed in FIGS. 5, 6 and 8, but with a greater force action, however, can be slid on the guide rods 39 and 40.

Before the coil-exchanging device 30 reaches the terminal position thereof, as shown in FIG. 9, for example, a core hold-back lever 122 articulatingly connected to the feed trough 36 by means of a strap 119 and a pin 120 and drawn by a tension spring 121 into holdback position is opened in that an end 123 of the lever 122 travels into and against a projection or strap 124 secured to the machine frame 53 of the core magazine 54.

Figure 5:
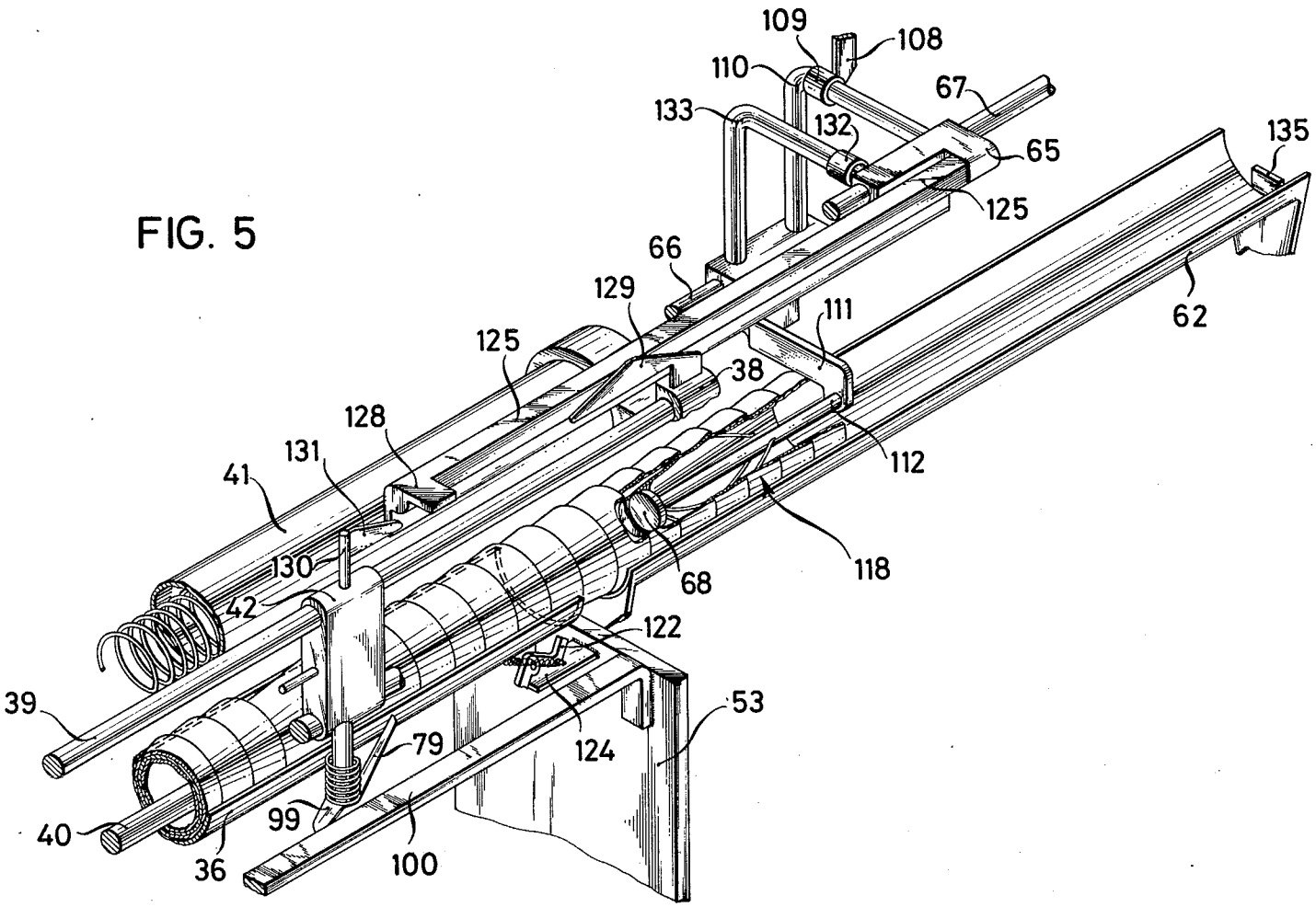
FIGS. 5 and 6 are views similar to that of FIG. 4 of the transfer device in different phases of the transfer operation.

FIG. 9 shows the details of the foregoing in the rest position thereof, and FIG. 5 in the operative position thereof.

A transmission system 101 for the drive motor 61, which is connected to the switchgear installation 76 through an electrically conductive line 102, is equipped with a non-illustrated free-wheeling device in combination with an inertial mass and a brake in a conventional manner so that after the motor 61 has been switched off, the conveyor belts 59 and 60 will continue to run until a trough 62 is located in delivery position.

After the coil exchanging device 30 has traveled into the end or terminal position shown in FIG. 1, the uppermost trough 62 of the core magazine 54 and the feed trough 36 of the take-up and storage device 35 of the coil exchanging device 30 are disposed in mutual alignment at the same level.

When the coil exchanging device 30 has actuated the terminal switch 74, the switchgear installation 76, which has been previously programmed for specific switching cycles, lets the drive motor 72 of the transfer device 64 start up. The motor 72 is formed as a geared motor and drives the chain sprocket 69 shown in FIG. 4.

Figure 7:
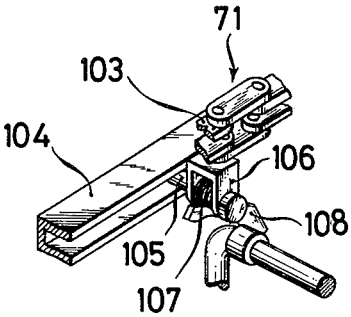
FIG. 7 is a fragmentary view of FIG. 4 showing a detail of the transfer device in another phase of the transfer operation.

A fork 106 guided by means of a pin 105 in a channel or U-shaped rail 104 is secured to a chain-link 103 of the chain 71, as shown especially in FIG. 7. A tightly wound torsion spring 107 holds a pawl 108 in the position shown in FIG. 4. The pawl 108 places itself in engagement with an abutment or stop sleeve 109 of a support tube 110 of the carriage 65 and entrains the carriage 65, the moment the chain 71 is set in motion.

A rod 112 is secured to a traverse 111 extending from the carriage 65, the plunger or ram 68 being located at the end of the rod 112. Three spread-out leaf springs 113, 114 and 115 are firmly connected to the plunger or ram 68.

While the chain 71 continues to revolve, the ram 68 travels into the rearmost coil core 116, preferably up to a stop 117 located at the inner wall surface of the core, as shown in FIG. 10. The leaf springs 113, 114 and 115 then engage the inner wall surface of the coil core 116 with the rear spring surface thereof, the spring ends thereof engaging the rod 112, and thereby tightly clamp the coil core 116. If no stops are provided at the inner wall surface of the coil core, the edge of the plunger or ram 68 engages the inner wall surface of the core and thus reinforces the clamping effect of the leaf springs 113, 114 and 115.

The moment a stick of cores 118 disposed on the uppermost trough 62 of the core magazine 54 is united with the remaining stick of cores 80 still present in the feed trough 36 of the coil exchanging device 30, the core stop 50 prevents further travel of the carriage 65. The pawl 108 accordingly disengages as shown in FIG. 7.

Figure 4:
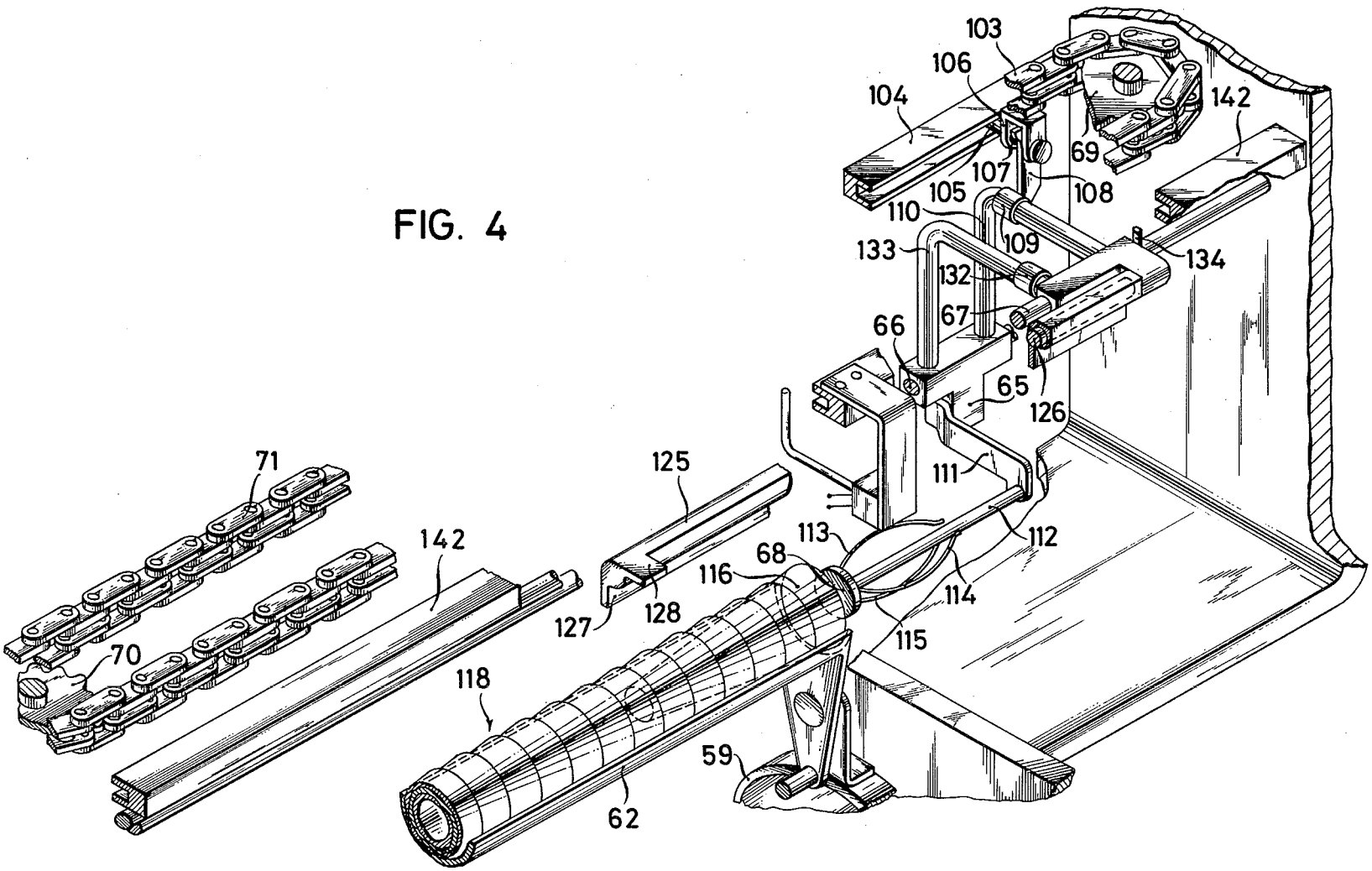
FIG. 4 is an enlarged perspective view of the transfer device of FIG. 1 for unwound conical coil cores which are telescoped within one another to form a rod or stick.
Figure 6:
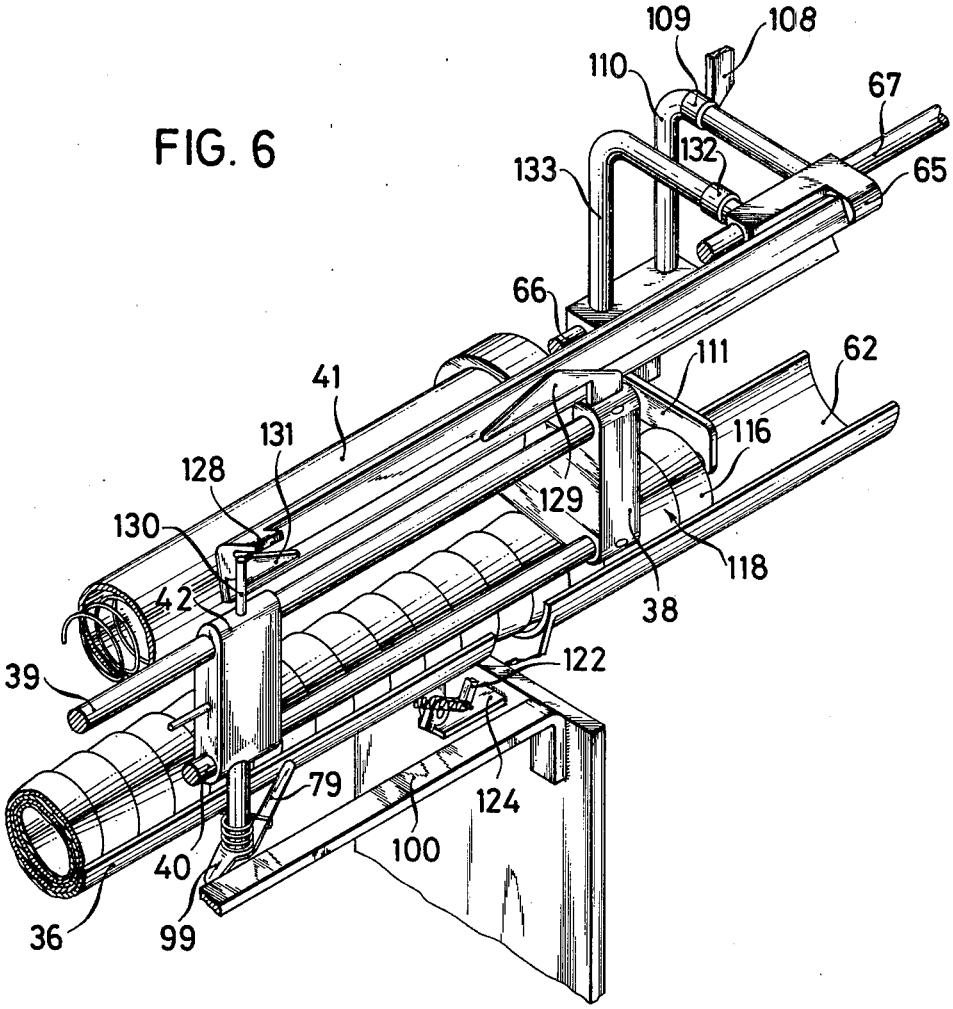

According to FIG. 4 a reset or return rail 125 rotatably mounted on the carriage 65 by means of a pin 126 possesses a long fin 127 extending perpendicularly downwardly in the figure, and a short fin 128 extending horizontally in the figure. The moment the carriage 65 is set in motion, the short fin 128 initially slides over a peak-shaped runner 129 secured to the carrier or support 38, and then over a right-triangular runner 130 secured to an entrainer pin 130 of the core counterrecoil mechanism 42, without moving the core counterrecoil mechanism 42 at that time. Upon traveling past the runners 129 and 131, the reset or return rail 125 is rotated, but then returns to the initial position thereof due to the dead weight of the long fin 127 itself. FIG. 6 shows how the short fin 128 actually slides along on the runner 131.

The drive motor 72 further rotates until the chain 71 has completed a full rotation. Upon the reversal or return travel of the chain link 103, the pawl 108 connected therewith engages the stop sleeve 132 of the carriage support tube 133, as shown in FIG. 8. The pin 105 is guided in the channel- or U-shaped rail 104 during the reversal or return travel of the chain link 103.

The carriage 65 is withdrawn back to the starting position thereof as the chain 71 continues to travel, the pawl 108 disengaging the moment the carriage 65 reaches the end or terminal stop 134 thereof (FIG. 4).

Beforehand, the short fin 128 of the reset or return rail 125 hooks itself on the entrainer pin 130 of the counterrecoil mechanism 42 and entrains the counterrecoil mechanism 42, the spring 83 of the spring-force storage device 41 being simultaneously stressed or tightened.

According to FIG. 8, the short fin 128 of the reset or return rail 125 has entrained the counterrcoil mechanism 42 actually up to the carrier or support 38 which serves as the end or terminal stop. Since the peak roof-shaped runner 129 of the carrier or support 38 lets the fin 128 slide high, it is urged to slide off by the entrainer pin 130, in the position shown in FIG. 8. The automatic brake of the counterrecoil mechanism 42 ensures that the latter remains stationary and is not again pulled back by the spring-force storage device 41. The lever 79 of the counterrecoil mechanism 42 can engage the end of the core stick 80 only when the lever arm 99 has traveled so far to the left-hand side of FIG. 8 that it slides off the stop rail 100, the brake being simultaneously released.

When the transfer operation has been completed and the pawl 108 is located approximately at the level of the chain sprocket wheel 70, as viewed in FIG. 4, the coil exchanging device 30 receives a travel command from the switchgear system 76 over a non-illustrated line. As the coil exchanging device 30 travels off, the lever end 123 of the core hold-back lever 122 again slides off the strap 124, the lever 122 accordingly swings upwardly counterclockwise, as viewed in FIG. 9, hooks behind the edge of the next-lying coil core and holds back all of the coil cores that are located on the feed trough 36 of the take-up and storage device 35. At this location, the core stick 80 is divided. That part of the core stick 80 disposed on the right-hand side of the core hold-back lever 122, as seen in FIG. 8, remains in the trough 62 and is passed back by the initially still-stationary and subsequently returning plunger or ram 68 into engagement with the stop 135 shown in FIG. 5.

If the coil cores are telescoped without any appreciable adhesive friction, the division of the core stick 80 is effected unconstrainedly, providing that the rod 112 according to FIG. 10 is guided so that the telescoped cores maintain a spacing coresponding to the distance a from the bottom of the trough 62. If the cores, on the other hand, are telescoped with moderate adhesive friction, a non-illustrated hold-down member constructed in a manner similar to the member 93 is employed.

The moment the pawl 108 has ended its pivoting, the drive motor 61 of the core magazine 54 receives the start command from the switchgear system 76. The shaft 136 is driven and the drive rollers 55 and 56 secured thereon are set in motion through the transmission system 101. The conveyor belts 59 and 60 are displaced in direction of the arrow shown in FIG. 2, guided by the reversing rollers 57 and 58. As shown in FIGS. 1 and 2, traverses 137 are secured to the conveyor belts 59 and 60, troughs 62 provided with end plates 138 and 139 being displaceably suspending by means of bearing pins which engage in suitable bores formed in the traverses 137. In order that the troughs 62 should always lie with the opening thereof facing upwardly, as viewed in FIG. 1, respective counterweights 140 are applied below the rotary axis of the troughs 62.

While the conveyor belts 59 and 60 slowly continue to move, the troughs 62 are manually or automatically supplied with sticks of cores 80. The slight swinging movements which arise as a result could disturb the transfer operation. Therefore, a guidance coulisse or rocker arm 141 is provided in the upper part of the core magazine 54, as viewed in FIG. 2 for example, slide members 142' engaging in the rocker arm 141 and being secured at the inner side of the end plate 138. In the region of the upper reversal location, as viewed in FIG. 2, disturbing or disruptive swinging movements are thereby avoided.

Normally, the core supply of the coil exchanging device 30 is always filled only if the coil exchanging device 30 recurrently stops at the machine end. The moment that the core stick 80, however, consists of only two or three cores, and the counterrecoil mechanism 42 has actuated the terminal switch 143 which is connected by a non-illustrated electrical line to the switchgear system 76, the coil exchanging device 30 receives the command from the switchgear system 76 to start up the core magazine 54, additionally, to accept new cores.

A terminal switch 144 secured on the U-rail 142 (FIG. 4) is disposed so that it is actuable by the carriage 65 when the plunger or ram 68 extends too far into the core stick 80 during the transfer operation; which is always the case when the core supply slid thereafter is insufficient to fill up the core stick 80 completely.

After the terminal switch 144, which is connected to the switchgear system 76 through non-illustrated electrical lines, is actuated, the switchgear system 76 gives the command to repeat the core transfer operation. In addition thereto, after termination of the first transfer operation, the drive motor 61 of the core magazine 54 is switched on momentarily, so that the conveyor belts 59 and 60 continue to turn through one division thereof. Thus, the next-following trough with a new core supply comes into the delivery position, whereupon the aforedescribed operative steps are repeated. Simultaneously, further travel of the coil exchanging device 30 is blocked until the repetition of the core transfer operation is ended.

As noted hereinbefore, the invention of the instant application is obviously not limited to the illustrated and described embodiment. Other embodiments are of course, also contempleted within the scope of the claims. For example, the take-up and storage device of the coil exchanging device 30 could have a maximal supply of more than one core stick. Whether or not the larger transportable core supply is advantageous depends upon the size of the core sticks, the number of the winding stations to be serviced, the duration of the coil exchange and the winding time for the individual coil.

I claim:

1. Method of feeding unwound conical coil cores to individual winding stations of a textile machine having a coil-exchanging device servicing a plurality of the winding stations for replacing fully wound coils with unwound conical coil cores which comprises initially telescoping unwound coil cores into sticks of cores, supplying the sticks of cores to a core magazine wherefrom the coil exchanging device successively replenishes its own supply of cores, and separating a respective individual unwound conical coil core from the supply of cores of the coil exchanging device and exchanging it for a fully wound coil at a respective winding station, and which includes maintaining relative movement between the winding stations and the core magazine, on the one hand, and the operationally ready coil exchanging device, on the other hand, at all times other than the time of coil exchange of the telescoped unwound coil cores and times at which take-up of the supplied sticks of cores by the core magazine occurs.

2. Method according to claim 1 which comprises driving the coil exchanging device back and forth to the winding stations and the core magazine in operationally ready condition at times other than when a coil exchange and a take-up of unwound coil cores are occurring.

3. Method according to claim 2 which comprises arresting the coil exchanging device at the core magazine at each arrival thereof thereat, and loading the coil exchanging device with at least a major part of a stick of cores from the core magazine so that the supply of the coil exchanging device contains the greatest possible number of conical coil cores.

4. Method according to claim 3 which comprises repeating the successive feeding of the sticks of cores so often until the coil exchanging device has taken up the greatest possible supply thereof.

5. Apparatus for carrying out a method of feeding unwound conical coil cores to individual winding stations of a textile machine comprising coil-exchanging means for replacing fully wound coils at a plurality of winding stations with unwound coinical coil cores, a core magazine at the textile machine having means for receiving therein sticks of telescoped coil cores, transfer means for transferring at least part of individual sticks of cores to the coil exchanging device from said core magazine, a take-up and storage device for sticks of cores and a delivery device for delivering individual coil cores, both located, at least in part, on the coil exchanging means, and means for maintaining relative movement between the winding stations and the core magazine, on the one hand, and the coil exchanging means, on the other hand, at all times other than respective times at which coil exchange and take-up of sticks of cores by the coil magazine occur.

6. Apparatus according to claim 5 wherein said core magazine is constructed as an elevator and comprises at least ten troughs for receiving respective sticks of cores therein continuously maintained in substantially horizontal position.

7. Apparatus according to claim 5 wherein said take-up and storage device of the coil exchanging has means for selectively taking up individual coil cores, a plurality of telescoped coil cores, a complete stick of coil cores and a plurality of sticks of coil cores.

8. Apparatus according to claim 5 wherein said delivery device comprises means responsive to the supply of unwound coil cores present in the coil exchanging apparatus for repeating the delivery operation and for dividing a stick of coil cores.

9. Apparatus according to claim 7 including core hold-back means for preventing the coil cores from being forced back to said core magazine from said take-up and storage device of the coil exchanging apparatus.

* * * * *